US009642473B2

(12) United States Patent
Chen

(10) Patent No.: US 9,642,473 B2
(45) Date of Patent: May 9, 2017

(54) BABY ROCKING BED WITH MULTIPLE FUNCTIONS

(71) Applicant: Way-Hong Chen, Taipei (TW)

(72) Inventor: Way-Hong Chen, Taipei (TW)

( * ) Notice: Subject to any disclaimer, the term of this patent is extended or adjusted under 35 U.S.C. 154(b) by 56 days.

(21) Appl. No.: 14/847,031

(22) Filed: Sep. 8, 2015

(65) Prior Publication Data

US 2017/0065097 A1 Mar. 9, 2017

(51) Int. Cl.

| | |
|---|---|
| ***A47D 9/00*** | (2006.01) |
| ***A47D 9/02*** | (2006.01) |
| ***A47D 15/00*** | (2006.01) |

(52) U.S. Cl.

CPC ..... *A47D 9/005* (2013.01); *A47D 9/02* (2013.01); *A47D 15/00* (2013.01)

(58) Field of Classification Search

CPC . A47D 9/00; A47D 9/005; A47D 9/02; A47D 9/04; A47D 15/00; A47D 13/00; A47D 13/02; A47D 13/06; A47D 13/061; A47D 13/066; A47D 13/063; A47D 13/065; A47D 13/10; A47D 13/102; A47D 13/105; A47D 13/107; A47D 1/00; A47D 1/02; A47D 1/08; A47C 21/006

See application file for complete search history.

(56) References Cited

U.S. PATENT DOCUMENTS

| | | | | |
|---|---|---|---|---|
| 7,896,431 | B2 * | 3/2011 | Cui | A47D 1/02 297/16.1 |
| 2011/0031783 | A1 * | 2/2011 | Zhong | A47D 13/102 297/32 |
| 2012/0274105 | A1 * | 11/2012 | Chen | A47D 1/08 297/183.1 |
| 2013/0214574 | A1 * | 8/2013 | Chapman | A47D 13/10 297/258.1 |
| 2013/0318709 | A1 * | 12/2013 | Bellows | A47D 9/02 5/101 |

FOREIGN PATENT DOCUMENTS

| | | | | |
|---|---|---|---|---|
| CN | GB 2500804 A | * 10/2013 | ..... | A47D 13/10 |

* cited by examiner

*Primary Examiner* — Nicholas Polito
*Assistant Examiner* — Amanda L Miller
(74) *Attorney, Agent, or Firm* — Alan D. Kamrath; Kamrath IP Lawfirm, P.A.

(57) ABSTRACT

A baby rocking bed includes a pivot unit, a lower frame connected with the pivot unit, a connecting unit connected with the lower frame, and an upper frame connected with the pivot unit and the connecting unit. Thus, when the movable member of the connecting unit is moved upward on the elbow pipe of the connecting unit, the upper frame is disposed at an inclined state so that the rocking bed is disposed at an inclined state to facilitate the user feeding the baby safely, and when the movable member is moved downward on the elbow pipe, the upper frame is disposed at a horizontal state so that the rocking bed is directly lowered and returned to the original position, without disturbing the sleeping baby.

8 Claims, 20 Drawing Sheets

BABY ROCKING BED WITH MULTIPLE FUNCTIONS

BACKGROUND OF THE INVENTION

1. Field of the Invention

The present invention relates to a bed for a baby and, more particularly, to a baby rocking bed.

2. Description of the Related Art

A conventional baby bed comprises an enclosure, and a bed part mounted in the enclosure for placing a baby. However, the conventional baby bed has a fixed structure and cannot be folded so that the conventional baby bed is not moved easily, thereby causing inconvenience to the user when needing to transport the conventional baby bed. In addition, the bed part of the conventional baby bed is disposed at a horizontal state and cannot be disposed at an inclined state so that the user cannot feed the baby easily and conveniently. Thus, the user has to hold the baby for feeding the baby and to take the baby into the enclosure after feeding so that the baby is easily disturbed by movement. Further, the conventional baby bed does not have a rocking function.

BRIEF SUMMARY OF THE INVENTION

The primary objective of the present invention is to provide a baby rocking bed with multiple functions.

In accordance with the present invention, there is provided a rocking bed comprising a pivot unit, a lower frame connected with the pivot unit, a connecting unit connected with the lower frame, and an upper frame connected with the pivot unit and the connecting unit. The pivot unit includes an upper plate, a lower plate pivotally connected with the upper plate by a pivot portion, an upper joint pivotally connected with the upper plate and provided with two upper supports, and a lower joint pivotally connected with the lower plate and provided with two lower supports. The upper plate has an outer periphery provided with two upper stop blocks. The lower plate has an outer periphery provided with two lower stop blocks. The upper joint has an outer periphery provided with two upper stop pieces that are capable of abutting the upper stop blocks of the upper plate. The lower joint has an outer periphery provided with two lower stop pieces that are capable of abutting the lower stop blocks of the lower plate. The lower frame includes two substantially U-shaped bottom bars each having a first end connected with one of the two lower supports of the lower joint. Each of the bottom bars has a mediate position provided with an arcuate portion which is provided with two stands. One of the two stands of each of the bottom bars has a bottom pivotally connected with a limit plate. The connecting unit includes a lower articulation provided with two lower supports each connected with a second end of one of the bottom bars, a base pivotally connected with the lower articulation and provided with a mounting recess, an elbow pipe inserted into the mounting recess and provided with a plurality of positioning holes, a movable member mounted on the elbow pipe, an upper articulation pivotally connected with the movable member and provided with two upper supports, a board mounted in the movable member, a positioning block movably mounted in the movable member and provided with two ramps, a projection formed on the positioning block and inserted into one of the positioning holes of the elbow pipe, an elastomer biased between the board and the positioning block, and two press buttons mounted on the movable member and each provided with a bevel face abutting one of the two ramps of the positioning block. The base has an outer periphery provided with two lower stop blocks. The movable member has a through hole mounted on the elbow pipe. The movable member has an outer periphery provided with two upper stop blocks. The lower articulation has an outer periphery provided with two lower stop pieces that are capable of abutting the lower stop blocks of the base. The upper articulation has an outer periphery provided with two upper stop pieces that are capable of abutting the upper stop blocks of the movable member. The upper frame includes two substantially U-shaped top bars each having a first end connected with one of the two upper supports of the upper joint and a second end connected with one of the two upper supports of the upper articulation. A bed part is mounted on the top bars of the upper frame.

According to the primary advantage of the present invention, when the movable member is moved upward on the elbow pipe, the upper frame is disposed at an inclined state so that the rocking bed is disposed at an inclined state to facilitate the user feeding the baby safely, and when the movable member is moved downward on the elbow pipe, the upper frame is disposed at a horizontal state so that the rocking bed is directly lowered and returned to the original position, without disturbing the sleeping baby.

According to another advantage of the present invention, the user only needs to press the two press buttons to unlock the movable member so that the movable member is unlocked easily and quickly, thereby facilitating the user adjusting the inclined angle of the rocking bed.

According to a further advantage of the present invention, the lower frame and the upper frame are collapsed by operation of the upper joint, the lower joint, the lower articulation and the upper articulation so as to fold the rocking bed so that the rocking bed is folded quickly, thereby facilitating the user folding and carrying the rocking bed.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
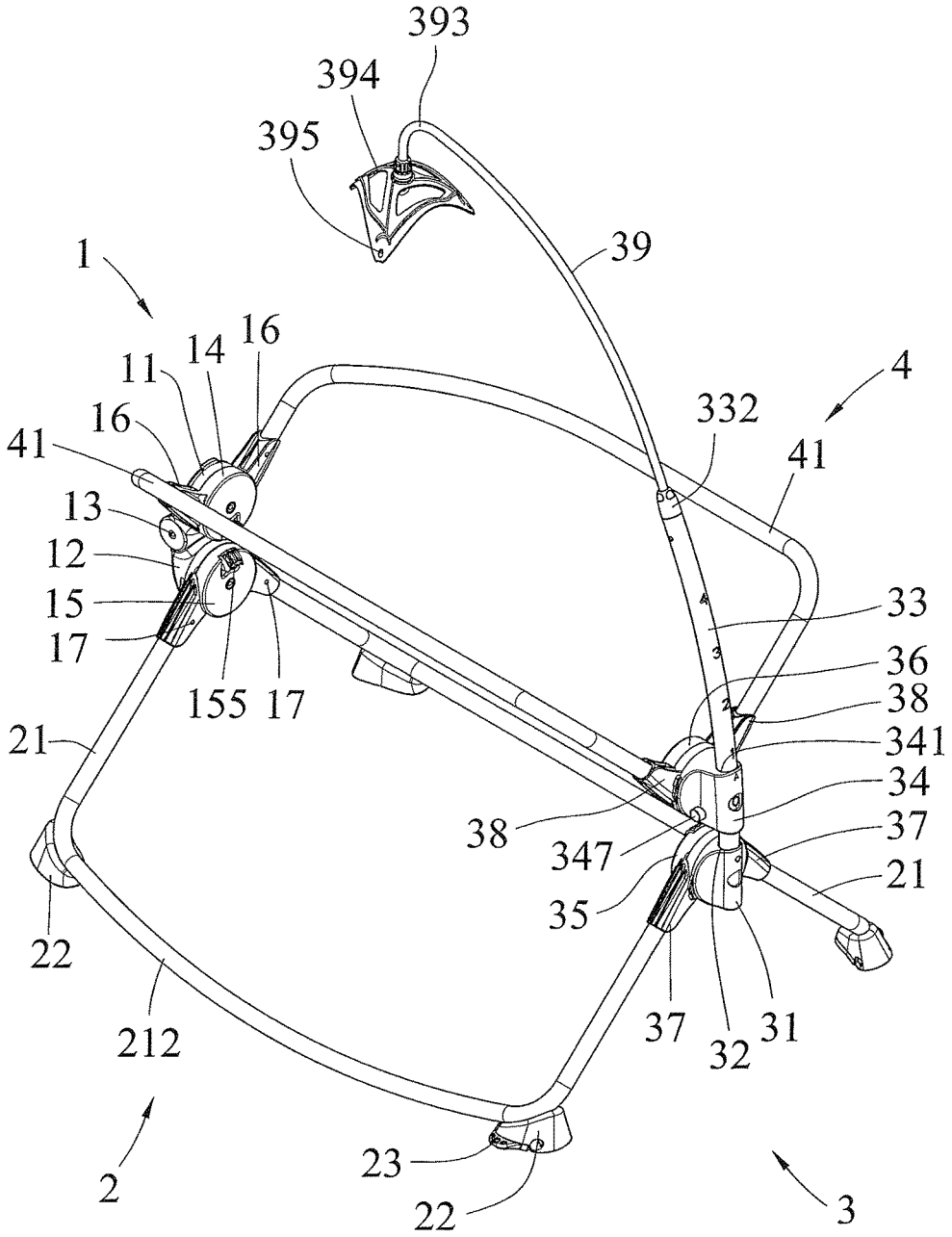
FIG. 1 is a perspective view of a baby rocking bed in accordance with the preferred embodiment of the present invention.
Figure 2:
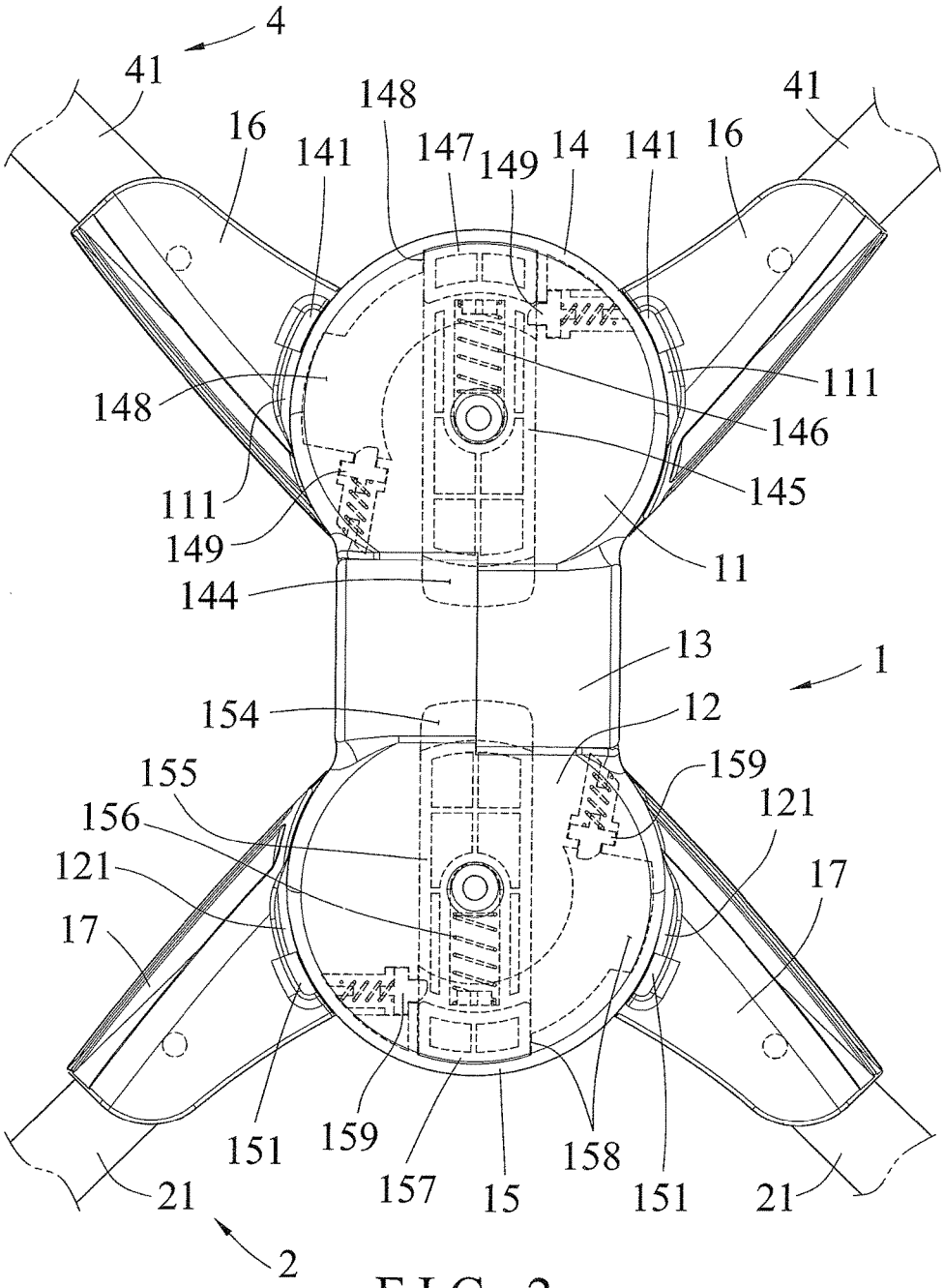
FIG. 2 is a planar view of a pivot unit of the baby rocking bed in accordance with the preferred embodiment of the present invention.
Figure 3:
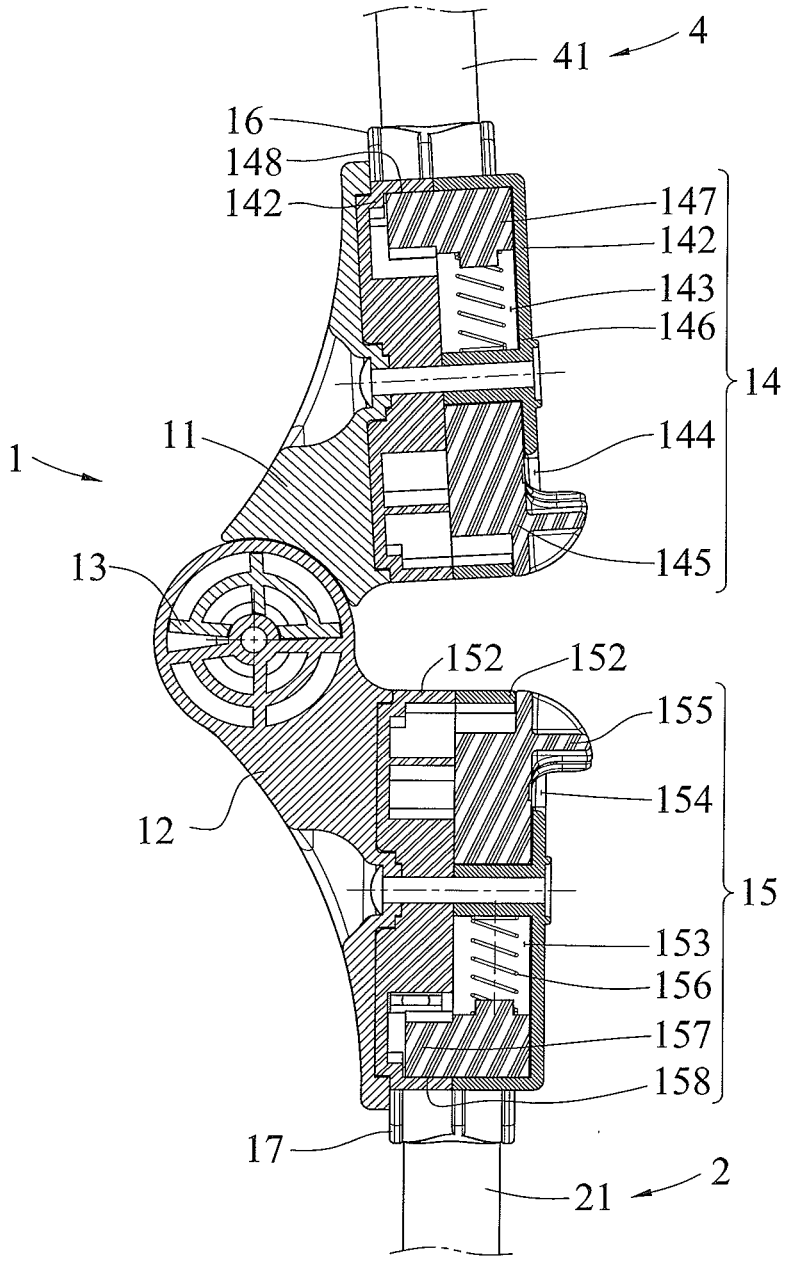
FIG. 3 is a cross-sectional view of the pivot unit of the baby rocking bed as shown in FIG. 2.

Referring to the drawings and initially to FIGS. 1-10, a baby rocking bed in accordance with the preferred embodiment of the present invention comprises a pivot unit 1, a lower frame 2 connected with the pivot unit 1, a connecting unit 3 connected with the lower frame 2, and an upper frame 4 connected with the pivot unit 1 and the connecting unit 3.

The pivot unit 1 includes an upper plate 11, a lower plate 12 pivotally connected with the upper plate 11 by a pivot portion 13, an upper joint 14 pivotally connected with the upper plate 11 and provided with two upper supports 16, and a lower joint 15 pivotally connected with the lower plate 12 and provided with two lower supports 17.

The upper plate 11 has an outer periphery provided with two upper stop blocks 111. The lower plate 12 has an outer periphery provided with two lower stop blocks 121. The upper joint 14 has an outer periphery provided with two upper stop pieces 141 that are capable of abutting the upper stop blocks 111 of the upper plate 11. Thus, after the upper joint 14 is rotated, the upper stop pieces 141 of the upper joint 14 are moved to abut the upper stop blocks 111 of the upper plate 11. The lower joint 15 has an outer periphery provided with two lower stop pieces 151 that are capable of abutting the lower stop blocks 121 of the lower plate 12. Thus, after the lower joint 15 is rotated, the lower stop pieces 151 of the lower joint 15 are moved to abut the lower stop blocks 121 of the lower plate 12.

The upper joint 14 of the pivot unit 1 includes two upper disks 142 pivotally connected with each other, an upper slide 145 mounted in a first one of the two upper disks 142, an upper elastic member 146 biased between the upper slide 145 and the first one of the two upper disks 142 to push the upper slide 145 downward, and two spring-biased upper displacement pieces 149 mounted in the two upper disks 142. The first one of the two upper disks 142 of the upper joint 14 has an interior provided with an upper slideway 143 which has a wall provided with an upper opening 144 which connects the upper slideway 143 to an ambient environment. A second one of the two upper disks 142 of the upper joint 14 has an interior provided with two upper locking grooves 148. The upper slide 145 of the upper joint 14 is mounted in the upper slideway 143 and has an end portion protruding outward from the upper opening 144 to facilitate the user's hand pressing the upper slide 145. The upper slide 145 of the upper joint 14 has a bottom provided with an upper locking portion 147 inserted into one of the two upper locking grooves 148. Each of the two spring-biased upper displacement pieces 149 of the upper joint 14 is located beside and movable into one of the two upper locking grooves 148.

The lower joint 15 of the pivot unit 1 includes two lower disks 152 pivotally connected with each other, a lower slide 155 mounted in a first one of the two lower disks 152, a lower elastic member 156 biased between the lower slide 155 and the first one of the two lower disks 152 to push the lower slide 155 downward, and two spring-biased lower displacement pieces 159 mounted in the two lower disks 152. The first one of the two lower disks 152 of the lower joint 15 has an interior provided with an lower slideway 153 which has a wall provided with an lower opening 154 which connects the lower slideway 153 to the ambient environment. A second one of the two lower disks 152 of the lower joint 15 has an interior provided with two lower locking grooves 158. The lower slide 155 of the lower joint 15 is mounted in the lower slideway 153 and has an end portion protruding outward from the lower opening 154 to facilitate the user's hand pressing the lower slide 155. The lower slide 155 of the lower joint 15 has a bottom provided with a lower locking portion 157 inserted into one of the two lower locking grooves 158. Each of the two spring-biased lower displacement pieces 159 of the lower joint 15 is located beside and movable into one of the two lower locking grooves 158.

Figure 5:
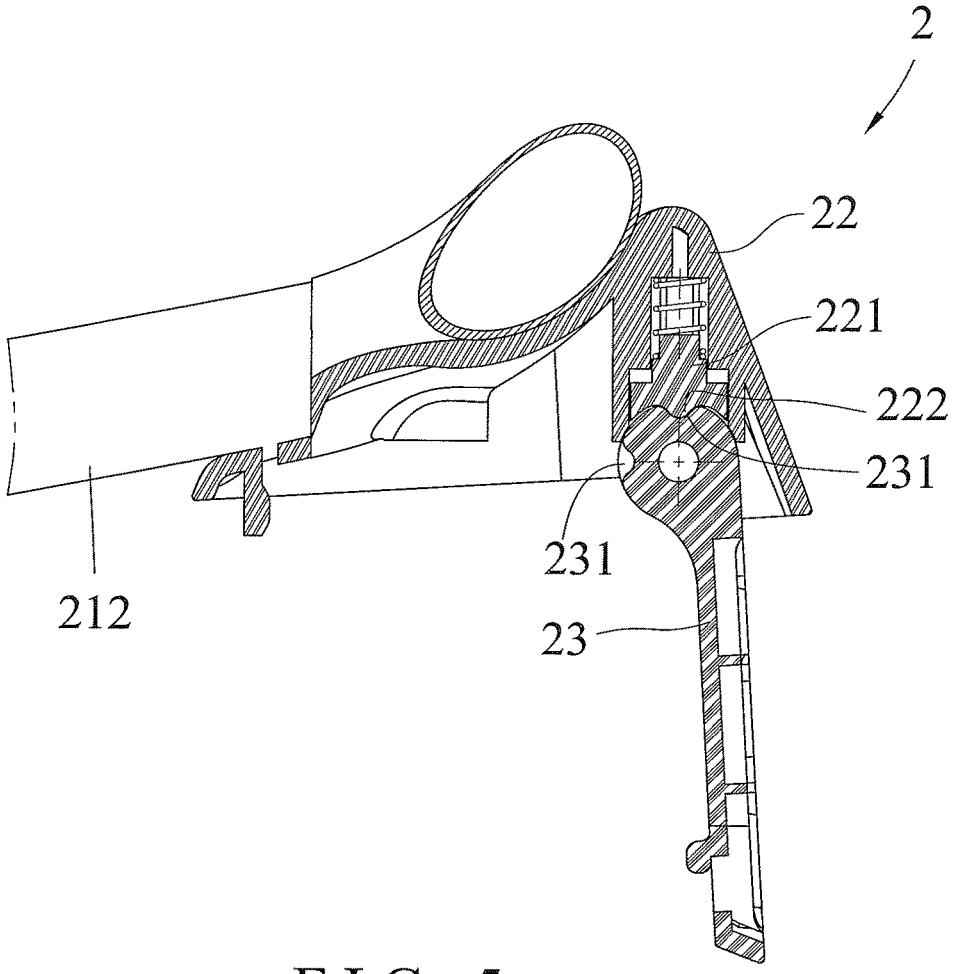
FIG. 5 is a cross-sectional view of a stand of the lower frame of the baby rocking bed in accordance with the preferred embodiment of the present invention.
Figure 6:
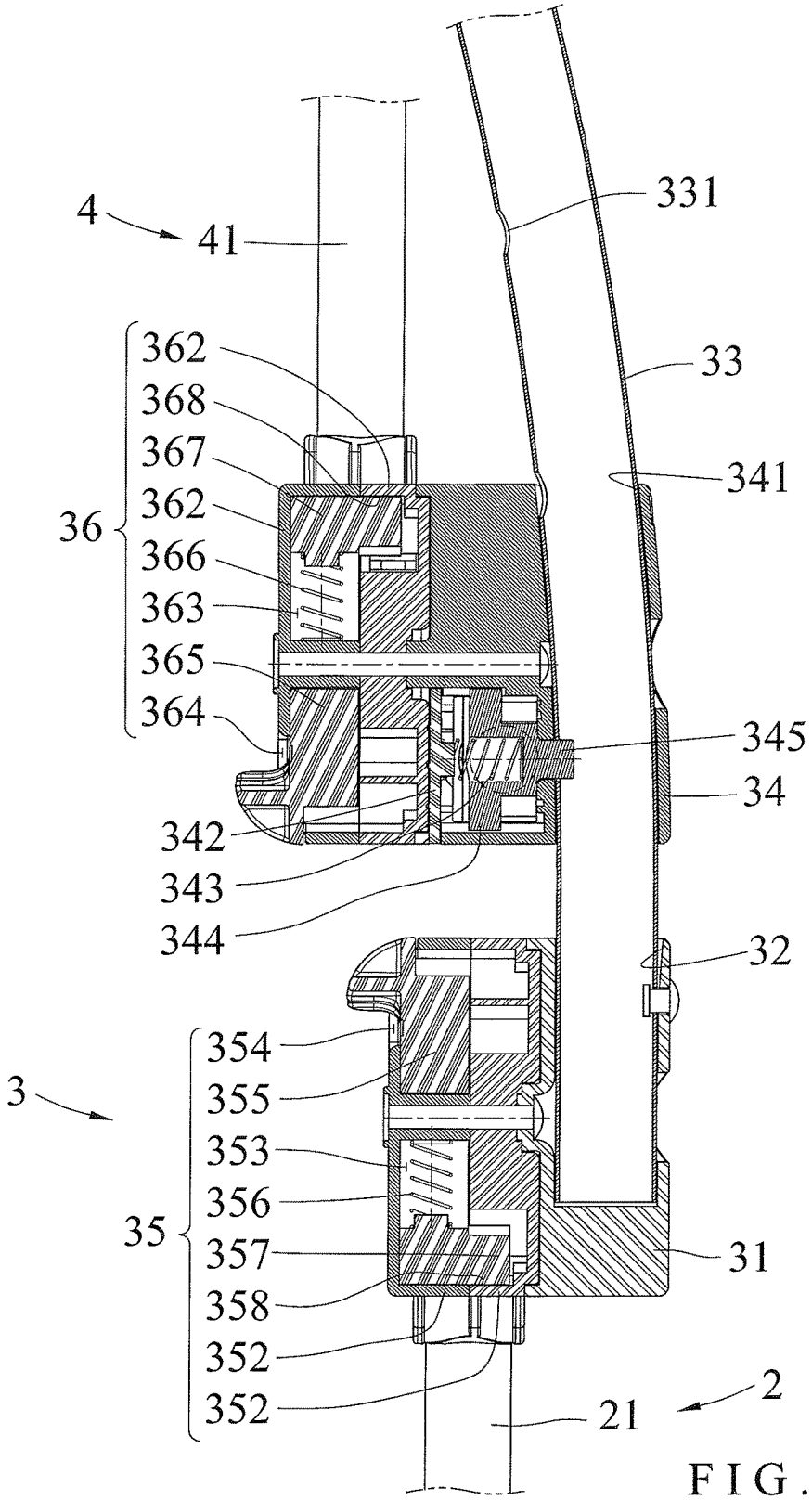
FIG. 6 is a cross-sectional view of a connecting unit of the baby rocking bed in accordance with the preferred embodiment of the present invention.
Figure 7:
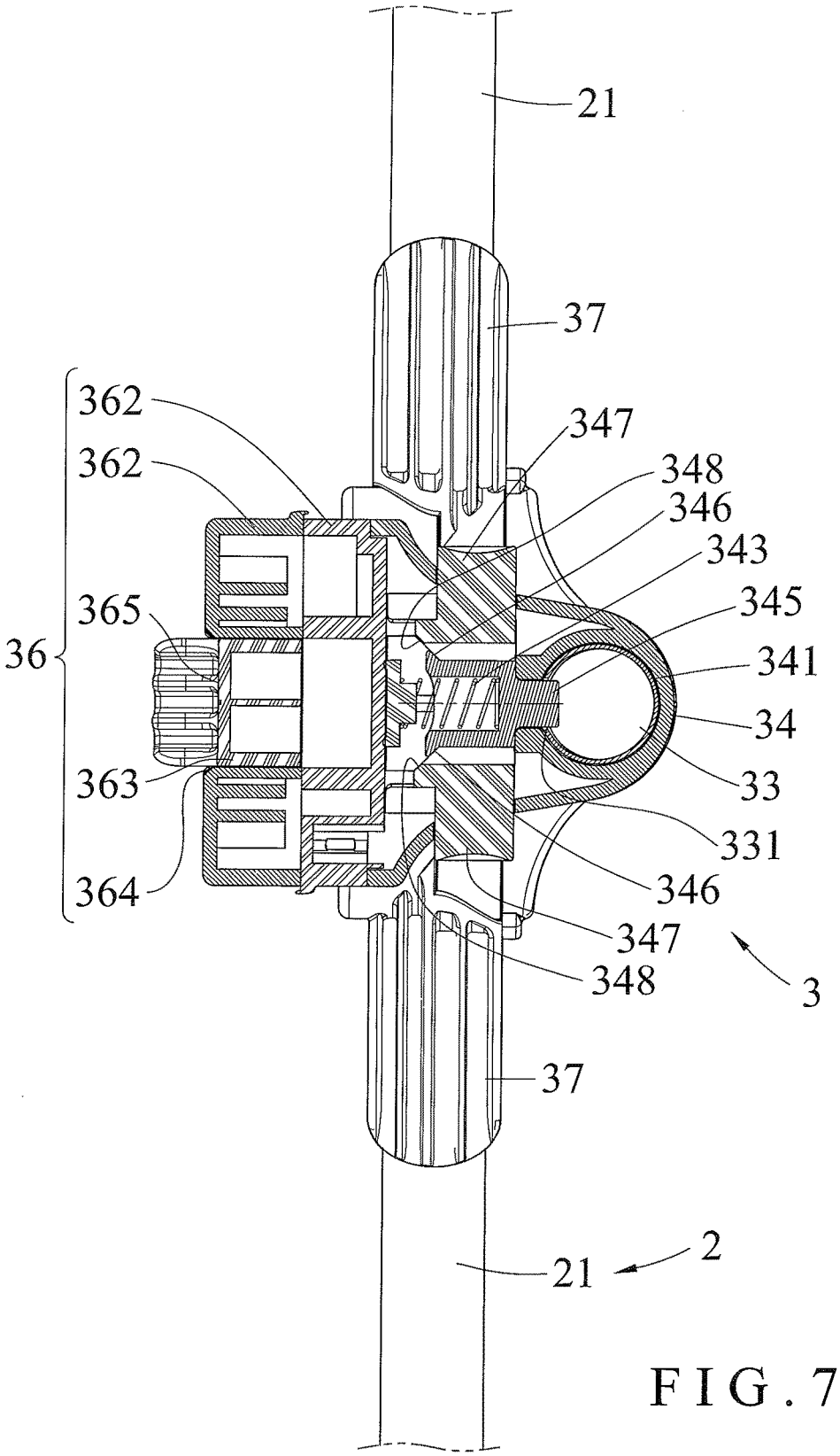
FIG. 7 is another cross-sectional view of the connecting unit of the baby rocking bed in accordance with the preferred embodiment of the present invention.
Figure 8:
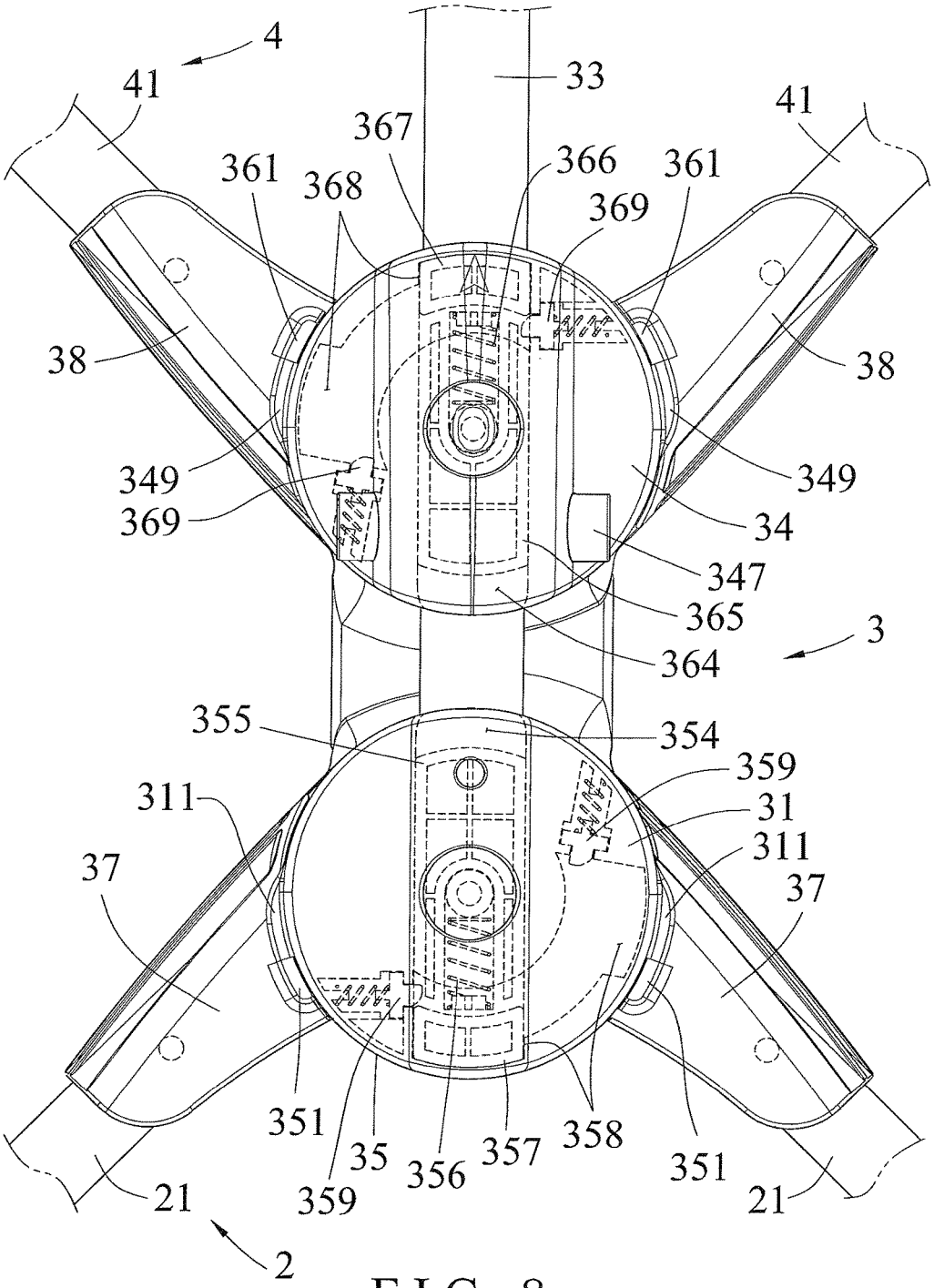
FIG. 8 is a planar view of the connecting unit of the baby rocking bed in accordance with the preferred embodiment of the present invention.

The lower frame 2 includes two substantially U-shaped bottom bars 21 each having a first end connected with one of the two lower supports 17 of the lower joint 15. Each of the bottom bars 21 has a mediate position provided with an arcuate portion 212 which is provided with two stands 22. One of the two stands 22 of each of the bottom bars 21 has a bottom pivotally connected with a limit plate 23. The limit plate 23 is pivoted downward relative to one of the two stands 22 to reach an extended position as shown in FIG. 5. The limit plate 23 is provided with two dimples 231. One of the two stands 22 of the lower frame 2 is provided with a spring-biased abutting block 221 which has a protruding boss 222 inserted into one of the two dimples 231 of the limit plate 23.

The connecting unit 3 includes a lower articulation 35 provided with two lower supports 37 each connected with a second end of one of the bottom bars 21, a base 31 pivotally connected with the lower articulation 35 and provided with a mounting recess 32, an elbow pipe 33 inserted into the mounting recess 32 and provided with a plurality of positioning holes 331, a movable member 34 mounted on the elbow pipe 33, an upper articulation 36 pivotally connected with the movable member 34 and provided with two upper supports 38, a board 342 mounted in the movable member 34, a positioning block 344 movably mounted in the movable member 34 and provided with two ramps 346, a projection 345 formed on the positioning block 344 and inserted into one of the positioning holes 331 of the elbow pipe 33, an elastomer 343 biased between the board 342 and the positioning block 344, and two press buttons 347 mounted on the movable member 34 and each provided with a bevel face 348 abutting one of the two ramps 346 of the positioning block 344.

The base 31 has an outer periphery provided with two lower stop blocks 311. The movable member 34 has a through hole 341 mounted on the elbow pipe 33. The movable member 34 has an outer periphery provided with two upper stop blocks 349. The lower articulation 35 has an outer periphery provided with two lower stop pieces 351 that are capable of abutting the lower stop blocks 311 of the base 31. Thus, after the lower articulation 35 is rotated, the lower stop pieces 351 of the lower articulation 35 are moved to abut the lower stop blocks 311 of the base 31. The upper articulation 36 has an outer periphery provided with two upper stop pieces 361 that are capable of abutting the upper stop blocks 349 of the movable member 34. Thus, after the upper articulation 36 is rotated, the upper stop pieces 361 of the upper articulation 36 are moved to abut the upper stop blocks 349 of the movable member 34.

The lower articulation 35 of the connecting unit 3 includes two lower disks 352 pivotally connected with each other, a lower slide 355 mounted in a first one of the two lower disks 352, a lower elastic member 356 biased between the lower slide 355 and the first one of the two lower disks 352 to push the lower slide 355 downward, and two spring-biased lower displacement pieces 359 mounted in the two lower disks 352. The first one of the two lower disks 352 of the lower articulation 35 has an interior provided with an lower slideway 353 which has a wall provided with an lower opening 354 which connects the lower slideway 353 to the ambient environment. A second one of the two lower disks 352 of the lower articulation 35 has an interior provided with two lower locking grooves 358. The lower slide 355 of the lower articulation 35 is mounted in the lower slideway 353 and has an end portion protruding outward from the lower opening 354 to facilitate the user's hand pressing the lower slide 355. The lower slide 355 of the lower articulation 35 has a bottom provided with a lower locking portion 357 inserted into one of the two lower locking grooves 358. Each of the two spring-biased lower displacement pieces 359 of the lower articulation 35 is located beside and movable into one of the two lower locking grooves 358.

The upper articulation 36 of the connecting unit 3 includes two upper disks 362 pivotally connected with each other, an upper slide 365 mounted in a first one of the two upper disks 362, an upper elastic member 366 biased between the upper slide 365 and the first one of the two upper disks 362 to push the upper slide 365 downward, and two spring-biased upper displacement pieces 369 mounted in the two upper disks 362. The first one of the two upper disks 362 of the upper articulation 36 has an interior provided with an upper slideway 363 which has a wall provided with an upper opening 364 which connects the upper slideway 363 to an ambient environment. A second one of the two upper disks 362 of the upper articulation 36 has an interior provided with two upper locking grooves 368. The upper slide 365 of the upper articulation 36 is mounted in the upper slideway 363 and has an end portion protruding outward from the upper opening 364 to facilitate the user's hand pressing the upper slide 365. The upper slide 365 of the upper articulation 36 has a bottom provided with an upper locking portion 367 inserted into one of the two upper locking grooves 368. Each of the two spring-biased upper displacement pieces 369 of the upper articulation 36 is located beside and movable into one of the two upper locking grooves 368.

The connecting unit 3 further includes a retaining sleeve 332 mounted on a top of the elbow pipe 33, an extension bar 39 having a lower end extending into the retaining sleeve 332 and an upper end provided with a bent portion 393, a push block 391 mounted on the lower end of the extension bar 39 and received in the retaining sleeve 332, a fixed piece 334 mounted in the retaining sleeve 332, a spring 335 biased between the fixed piece 334 and the push block 391, and a mounting bracket 394 pivotally connected with the bent portion 393 of the extension bar 39. The retaining sleeve 332 has an interior provided with a plurality of slots 333. The push block 391 has a top provided with a plurality of inserts 392 inserted into the slots 333 of the retaining sleeve 332. The mounting bracket 394 has a periphery provided with a plurality of hanging holes 395 for hanging items, such as dolls and the like.

The upper frame 4 includes two substantially U-shaped top bars 41 each having a first end connected with one of the two upper supports 16 of the upper joint 14 and a second end connected with one of the two upper supports 38 of the upper articulation 36. Abed part (such as a sleeping basket or the like) is mounted on the top bars 41 of the upper frame 4. Preferably, a mosquito curtain is mounted on the mounting bracket 394 and depends downward to cover the bed part.

Figure 4:
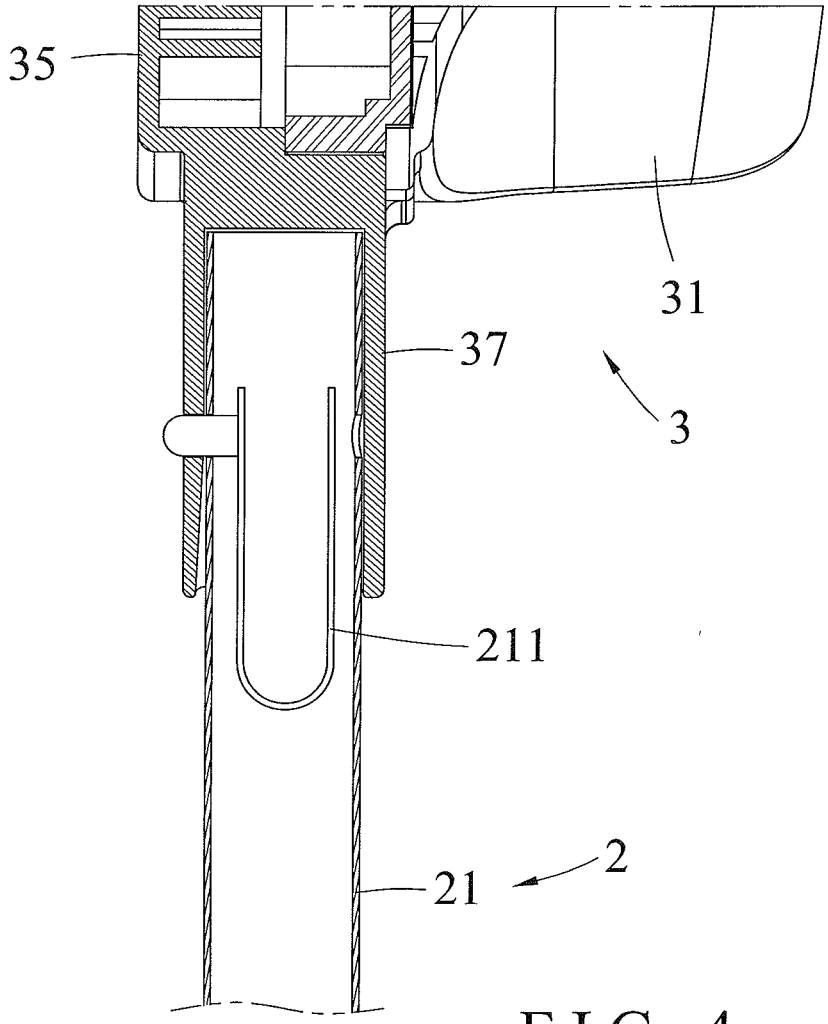
FIG. 4 is a cross-sectional view of a bottom bar of a lower frame of the baby rocking bed in accordance with the preferred embodiment of the present invention.

In the preferred embodiment of the present invention, the first end of each of the bottom bars 21 is secured to one of the two lower supports 17 of the lower joint 15 by a lower elastic plate 211, and each of the lower supports 37 of the lower articulation 35 is secured to the second end of one of the bottom bars 21 by the lower elastic plate 211 (see FIG. 4). In addition, the first end of each of the top bars 41 is secured to one of the two upper supports 16 of the upper joint 14 by an upper elastic plate 411, and the second end of each of the top bars 41 is secured to one of the two upper supports 38 of the upper articulation 36 by the upper elastic plate 411 (see FIG. 10).

Figure 11:
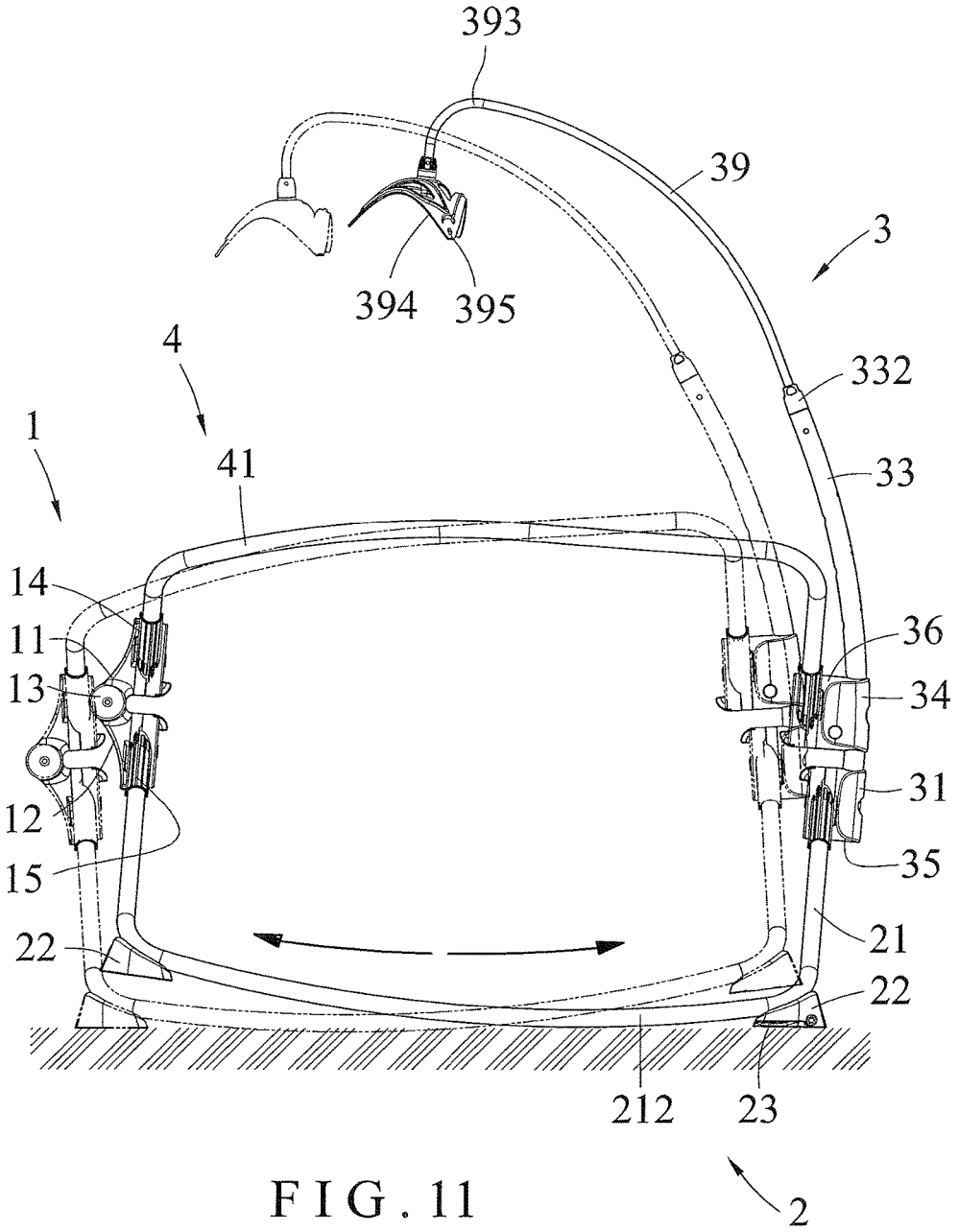
FIG. 11 is a schematic front operational view of the baby rocking bed as shown in FIG. 1 in use.

In operation, referring to FIG. 11, the arcuate portion 212 of each of the bottom bars 21 abuts the ground so that when the lower frame 2 is rocked, the upper frame 4 sways to provide a comfortable sensation to the baby placed in the upper frame 4. After the baby is sleeping, the limit plate 23 on each of the bottom bars 21 is expanded to abut the ground, so that two stands 22 are lifted, and the other two stands 22 abut the ground. Thus, the lower frame 2 stops rocking and is disposed at a stationary state.

Figure 12:
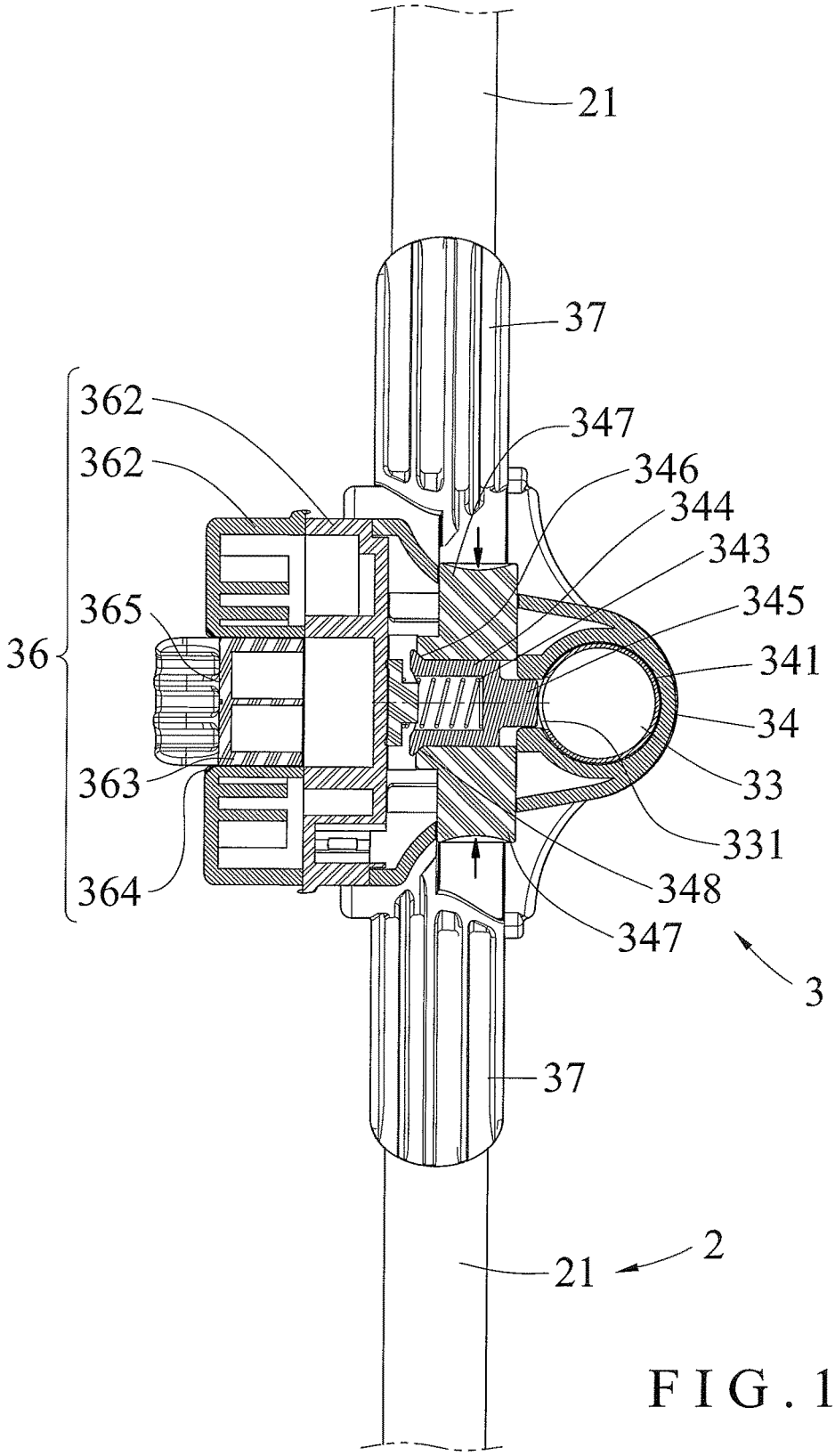
FIG. 12 is a schematic operational view of the baby rocking bed as shown in FIG. 7.
Figure 13:
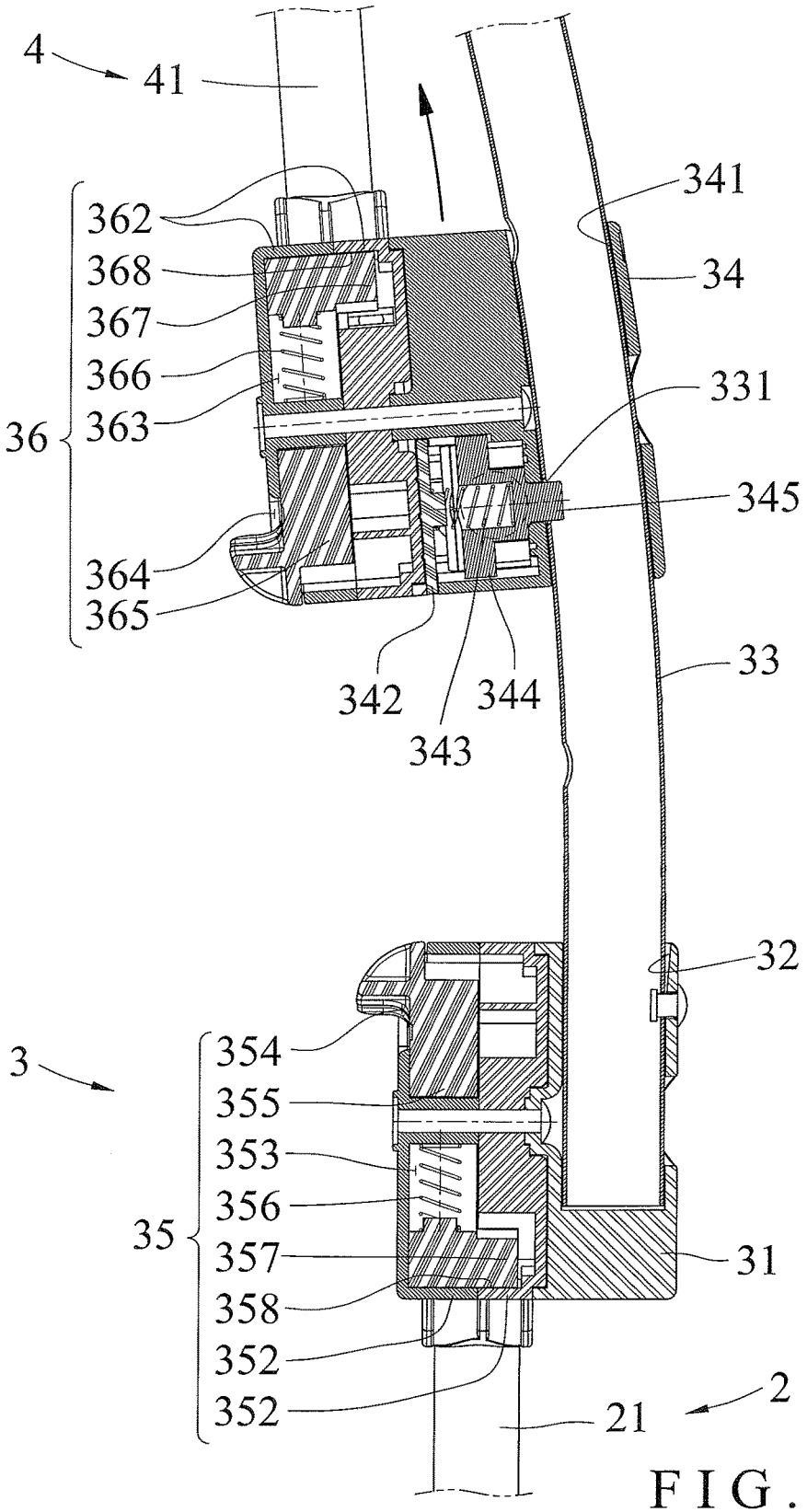
FIG. 13 is a schematic operational view of the baby rocking bed as shown in FIG. 6.
Figure 14:
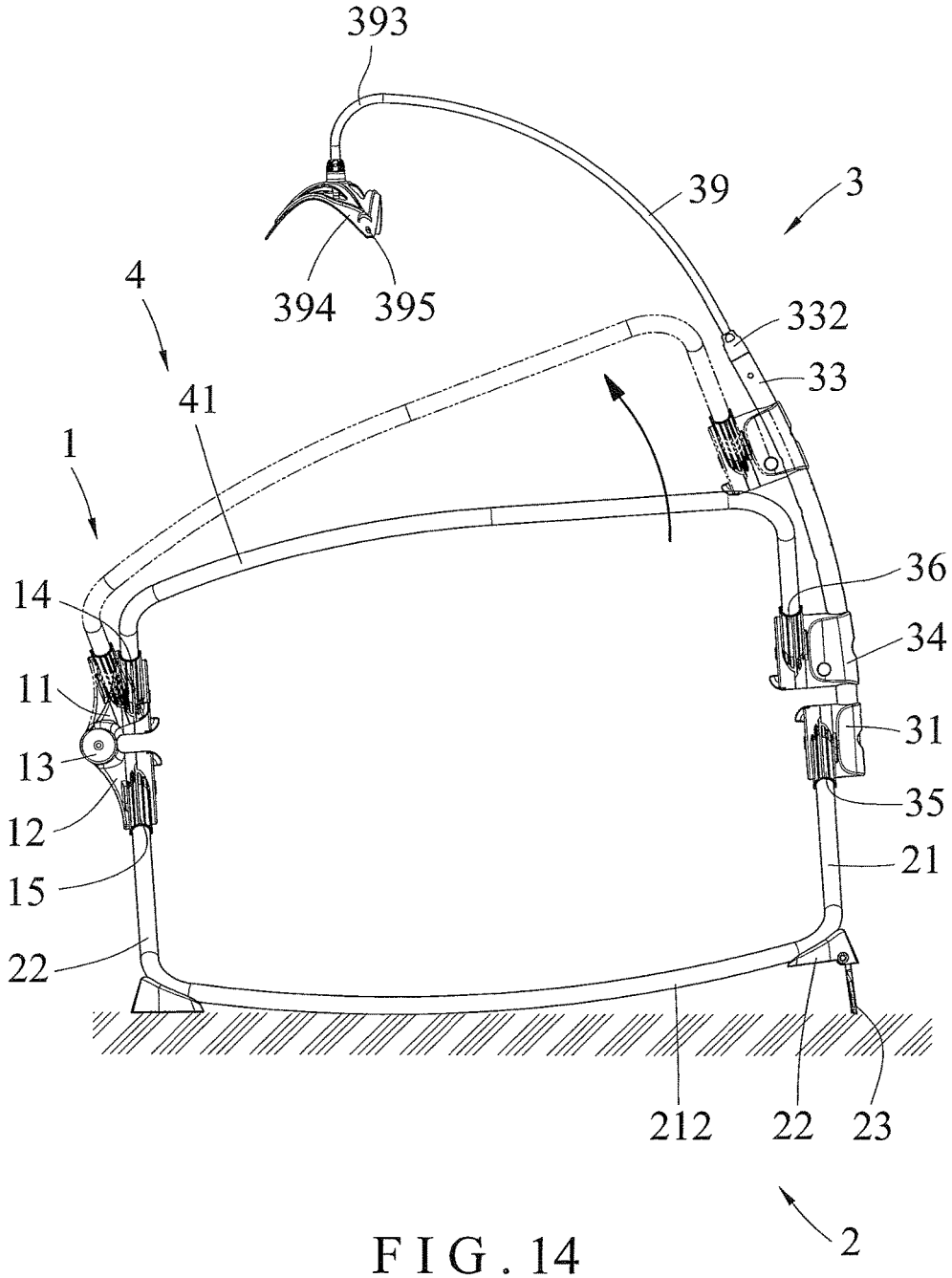
FIG. 14 is a schematic front operational view of the baby rocking bed as shown in FIG. 1 in use.

Referring now to FIGS. 12-14 with reference to FIGS. 1-8, when the two press buttons 347 are pressed inward as shown in FIG. 12, the bevel face 348 of each of the two press buttons 347 presses one of the two ramps 346 of the positioning block 344 to move the positioning block 344 backward and to compress the elastomer 343 so that the projection 345 is detached from one of the positioning holes 331 of the elbow pipe 33, thereby unlocking the movable member 34. In such a manner, the movable member 34 is moved upward on the elbow pipe 33 as shown in FIG. 13 to drive the upper articulation 36 which drives the top bars 41 which drive the upper joint 14 which drives the upper plate 11 so that the upper plate 11 is pivoted upward about the pivot portion 13. Thus, the top bars 41 are disposed at an inclined state as shown in FIG. 14. After the two press buttons 347 are released, the positioning block 344 is pushed forward by the restoring force of the elastomer 343 so that the projection 345 is inserted into another one of the positioning holes 331 of the elbow pipe 33, thereby again locking the movable member 34. Thus, the rocking bed is disposed at an inclined state to facilitate the user feeding the baby. At this time, the limit plate 23 on each of the bottom bars 21 is pivoted and expanded downward to abut the ground as shown in FIG. 14, so that two stands 22 are lifted, and the other two stands 22 abut the ground. Thus, the lower frame 2 is disposed at a steady state to prevent the arcuate portion 212 of each of the bottom bars 21 from being rocked so that the rocking bed is supported stably and will not be vibrated freely.

Figure 15:
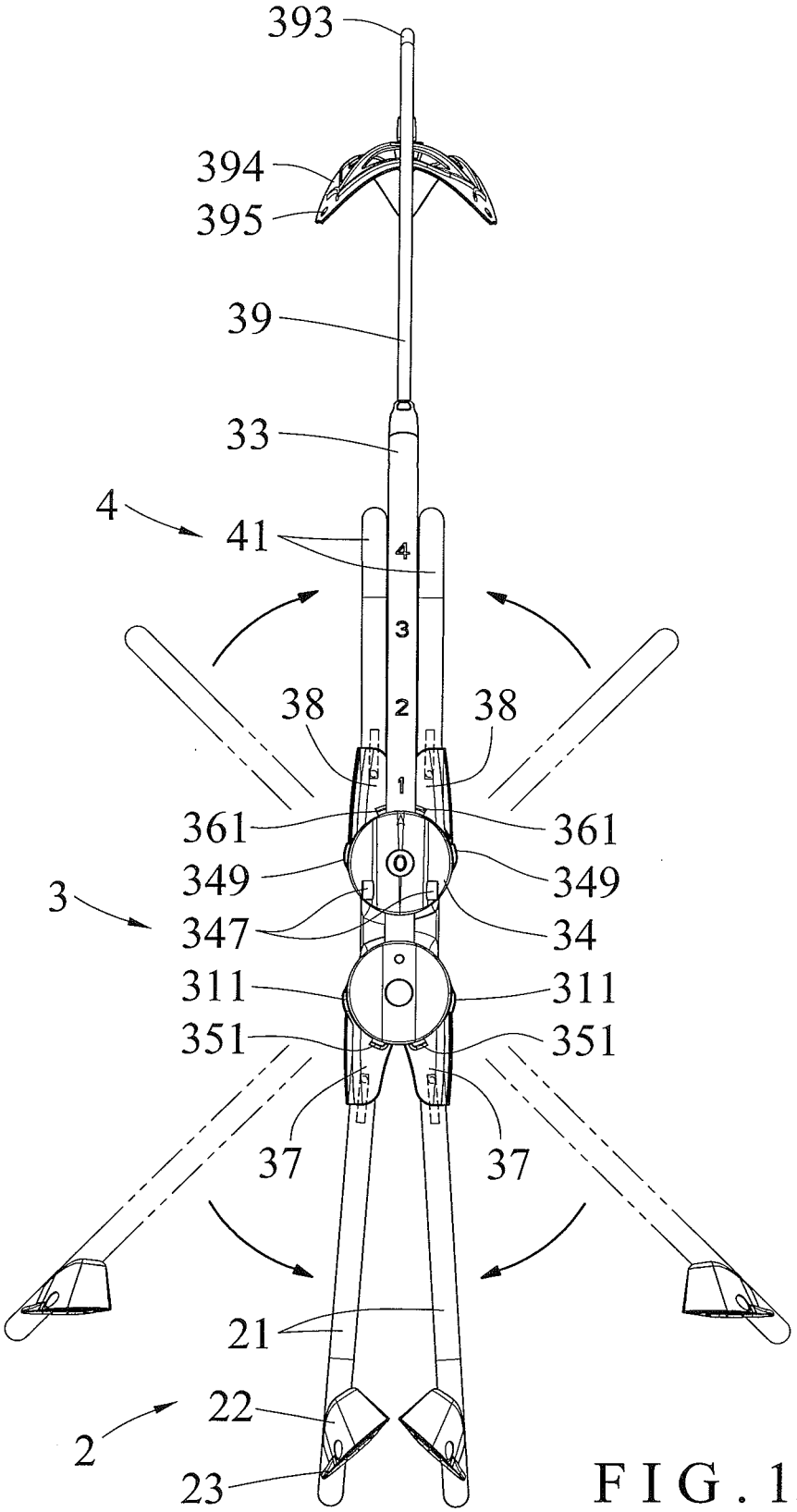
FIG. 15 is a schematic side operational view of the baby rocking bed as shown in FIG. 1 in folding.

Referring now to FIG. 15, when the user wishes to fold the lower frame 2 and the upper frame 4, the upper joint 14, the lower joint 15, the lower articulation 35 and the upper articulation 36 are rotated to collapse the bottom bars 21 of the lower frame 2 and the top bars 41 of the upper frame 4.

Figure 16:
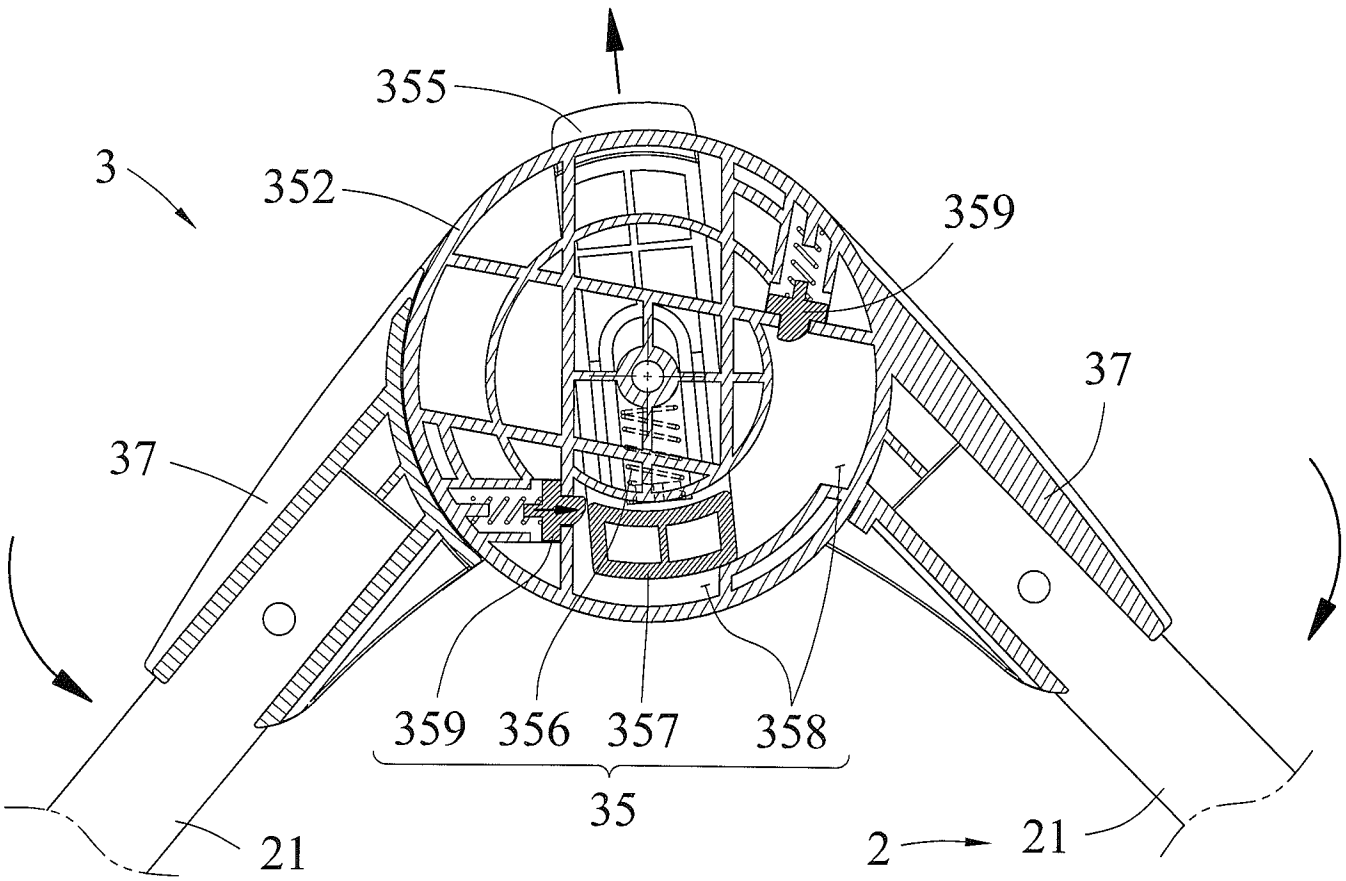
FIG. 16 is a schematic cross-sectional operational view of the baby rocking bed as shown in FIG. 8 in folding.
Figure 17:
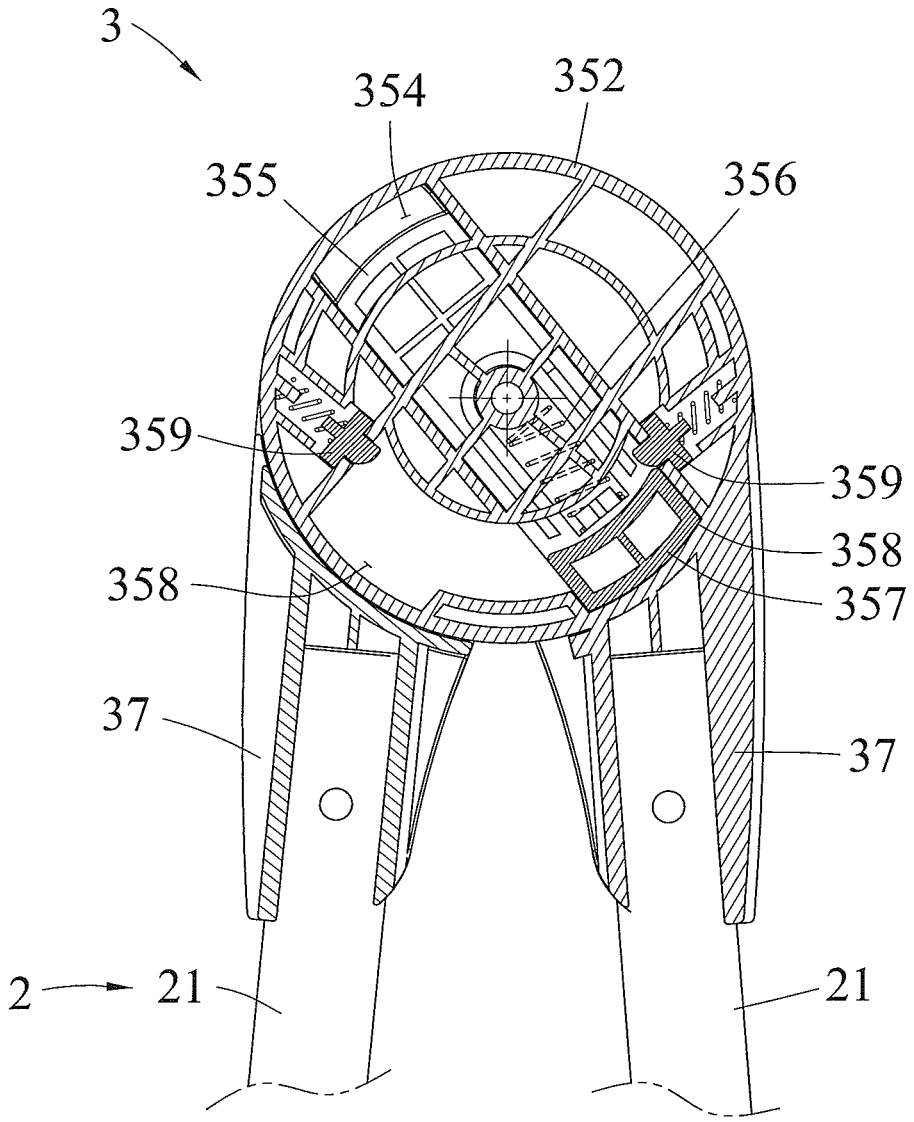
FIG. 17 is a schematic operational view of the baby rocking bed as shown in FIG. 16 in folding.

Referring now to FIGS. 16 and 17 with reference to FIGS. 1-8, operation of the lower articulation 35 is performed. When the lower slide 355 protruding outward from the lower opening 354 is pushed by the user's finger, the lower elastic member 356 is compressed by the lower slide 355, and the lower slide 355 is moved in the lower slideway 353 in one direction, so that the lower locking portion 357 of the lower slide 355 is detached from one of the two lower locking grooves 358. At this time, the lower locking portion 357 of the lower slide 355 is pushed by the elastic force of one of the two spring-biased lower displacement pieces 359 as shown in FIG. 16 and is moved toward the other one of the two lower locking grooves 358, so that the first one of the two lower disks 352 is driven and rotated relative to second one of the two lower disks 352, and the two lower disks 352 are unlocked and can be rotated freely. In such a manner, the lower articulation 35 is unlocked so that the bottom bars 21 and the lower supports 37 are moved inward to drive the two lower disks 352 to rotate relative to each other. When the lower locking portion 357 of the lower slide 355 reaches the other one of the two lower locking grooves 358, the lower slide 355 is pushed by the restoring force of the lower elastic member 356, so that the lower locking portion 357 of the lower slide 355 is inserted into the other one of the two lower locking grooves 358 as shown in FIG. 17 to lock the two lower disks 352, thereby locking the lower articulation 35.

It is appreciated that, operation of the upper joint 14, the lower joint 15 and the upper articulation 36 is similar to that of the lower articulation 35. Thus, the lower frame 2 and the upper frame 4 are collapsed by operation of the upper joint 14, the lower joint 15, the lower articulation 35 and the upper articulation 36 so as to fold the rocking bed.

Figure 18:
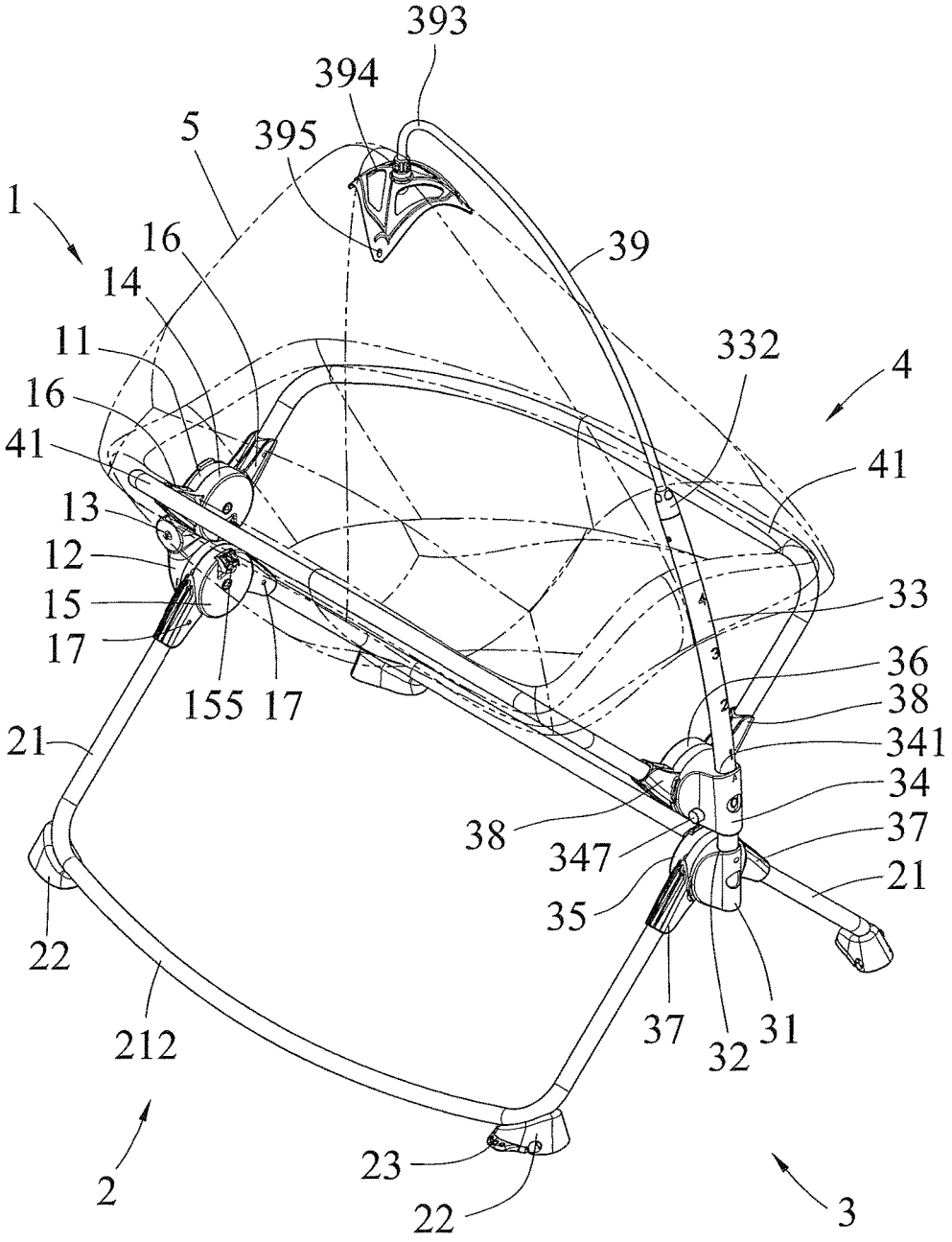
FIG. 18 is a perspective view of a baby rocking bed in accordance with another preferred embodiment of the present invention.

Referring now to FIG. 18, the mounting bracket 394 on the extension bar 39 is used for hanging a mosquito curtain 5 to cover the bed part supported by the top bars 41 of the upper frame 4.

Figure 9:
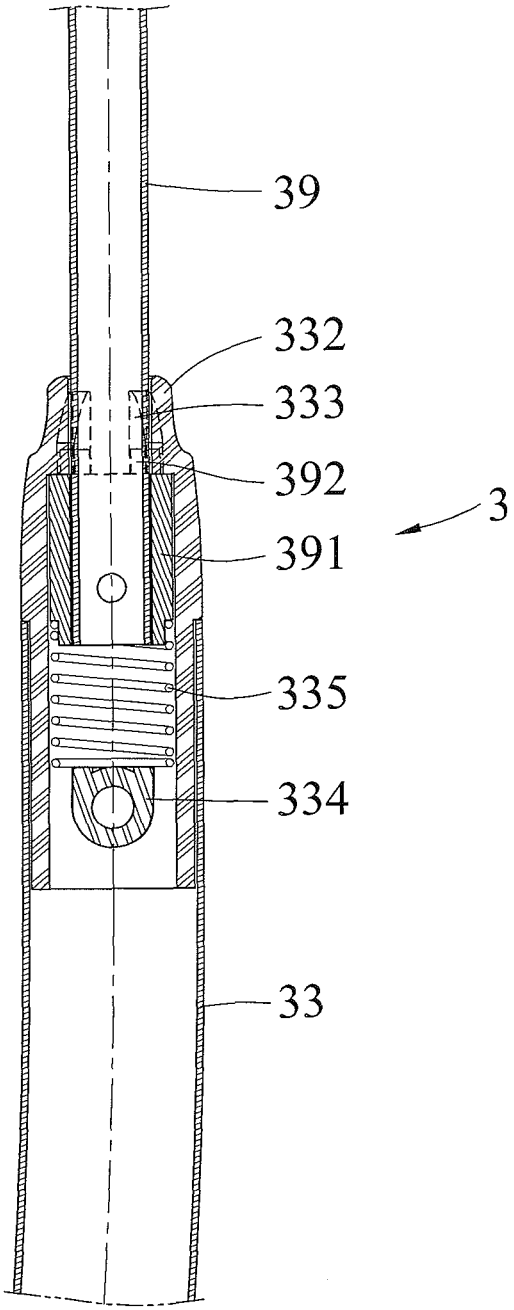
FIG. 9 is another cross-sectional view of the connecting unit of the baby rocking bed in accordance with the preferred embodiment of the present invention.
Figure 10:
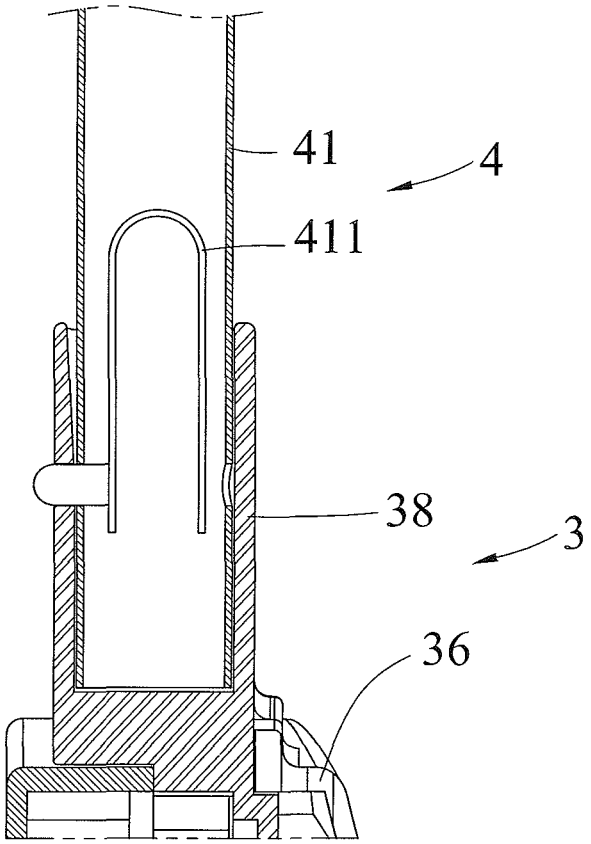
FIG. 10 is a cross-sectional view of a top bar of a top frame of the baby rocking bed in accordance with the preferred embodiment of the present invention.
Figure 19:
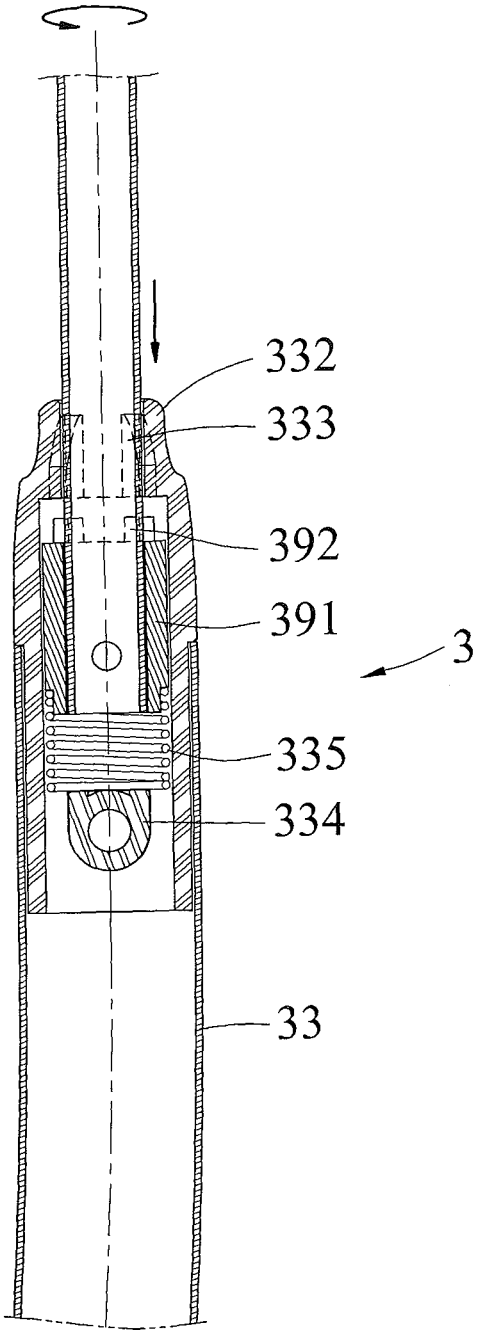
FIG. 19 is a schematic operational view of the baby rocking bed as shown in FIG. 9.
Figure 20:
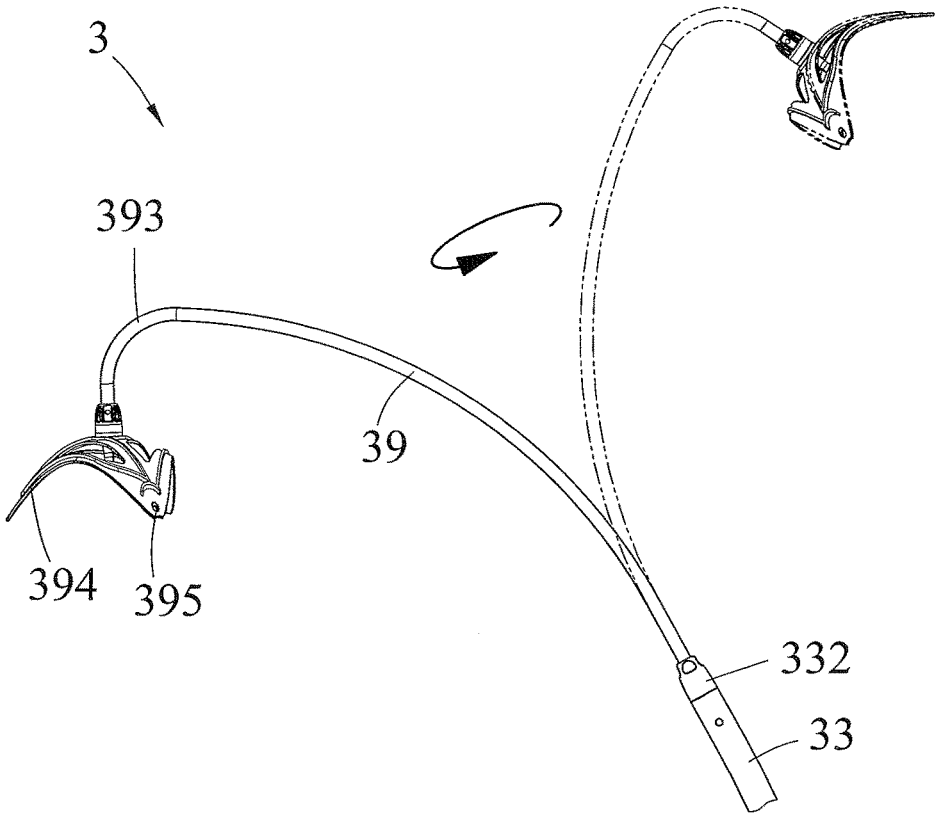
FIG. 20 is a schematic operational view of an extension bar of the baby rocking bed as shown in FIG. 1.

Referring now to FIGS. 19 and 20 with reference to FIGS. 1-9, when the extension bar 39 is pressed toward the elbow pipe 33 as shown in FIG. 19, the push block 391 is moved downward to compress the spring 335, and the inserts 392 of the push block 391 are moved to detach from the slots 333 of the retaining sleeve 332, so as to unlock the push block 391 from the retaining sleeve 332, and to unlock the extension bar 39 from the elbow pipe 33, so that the extension bar 39 can be rotated freely relative to the elbow pipe 33 as shown in FIG. 20 so as to change and regulate the direction of the bent portion 393 and the mounting bracket 394. When the extension bar 39 is released, the extension bar 39 and the push block 391 are pushed upward by the restoring force of the spring 335, and the inserts 392 of the push block 391 are moved and inserted into the slots 333 of the retaining sleeve 332 as shown in FIG. 9, so as to lock the push block 391 in the retaining sleeve 332, and to lock the extension bar 39 on the elbow pipe 33, so that the extension bar 39 is positioned on the elbow pipe 33.

Accordingly, when the movable member 34 is moved upward on the elbow pipe 33, the upper frame 4 is disposed at an inclined state so that the rocking bed is disposed at an inclined state to facilitate the user feeding the baby safely, and when the movable member 34 is moved downward on the elbow pipe 33, the upper frame 4 is disposed at a horizontal state so that the rocking bed is directly lowered and returned to the original position, without disturbing the sleeping baby. In addition, the user only needs to press the two press buttons 347 to unlock the movable member 34 so that the movable member 34 is unlocked easily and quickly, thereby facilitating the user adjusting the inclined angle of the rocking bed. Further, the lower frame 2 and the upper frame 4 are collapsed by operation of the upper joint 14, the lower joint 15, the lower articulation 35 and the upper articulation 36 so as to fold the rocking bed so that the rocking bed is folded quickly, thereby facilitating the user folding and carrying the rocking bed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A rocking bed comprising:

a pivot unit;

a lower frame connected with the pivot unit;

a connecting unit connected with the lower frame; and an upper frame connected with the pivot unit and the connecting unit;

wherein:

the pivot unit includes:

an upper plate;

a lower plate pivotally connected with the upper plate by a pivot portion;

an upper joint pivotally connected with the upper plate and provided with two upper supports; and a lower joint pivotally connected with the lower plate and provided with two lower supports;

the upper plate has an outer periphery provided with two upper stop blocks;

the lower plate has an outer periphery provided with two lower stop blocks;

the upper joint has an outer periphery provided with two upper stop pieces that are capable of abutting the upper stop blocks of the upper plate;

the lower joint has an outer periphery provided with two lower stop pieces that are capable of abutting the lower stop blocks of the lower plate;

the lower frame includes two substantially U-shaped bottom bars each having a first end connected with one of the two lower supports of the lower joint;

each of the bottom bars has a mediate position provided with an arcuate portion which is provided with two stands;

one of the two stands of each of the bottom bars has a bottom pivotally connected with a limit plate;

the connecting unit includes:

a lower articulation provided with two lower supports each connected with a second end of one of the bottom bars;

a base pivotally connected with the lower articulation and provided with a mounting recess;

an elbow pipe inserted into the mounting recess and provided with a plurality of positioning holes;

a movable member mounted on the elbow pipe;

an upper articulation pivotally connected with the movable member and provided with two upper supports;

a board mounted in the movable member;

a positioning block movably mounted in the movable member and provided with two ramps;

a projection formed on the positioning block and inserted into one of the positioning holes of the elbow pipe;

an elastomer biased between the board and the positioning block; and two press buttons mounted on the movable member and each provided with a bevel face abutting one of the two ramps of the positioning block;

the base has an outer periphery provided with two lower stop blocks;

the movable member has a through hole mounted on the elbow pipe;

the movable member has an outer periphery provided with two upper stop blocks;

the lower articulation has an outer periphery provided with two lower stop pieces that are capable of abutting the lower stop blocks of the base;

the upper articulation has an outer periphery provided with two upper stop pieces that are capable of abutting the upper stop blocks of the movable member;

the upper frame includes two substantially U-shaped top bars each having a first end connected with one of the two upper supports of the upper joint and a second end connected with one of the two upper supports of the upper articulation; and a bed part is mounted on the top bars of the upper frame.

2. The rocking bed of claim 1, wherein:

each of the upper joint of the pivot unit and the upper articulation of the connecting unit includes:

two upper disks pivotally connected with each other;

an upper slide mounted in a first one of the two upper disks;

an upper elastic member biased between the upper slide and the first one of the two upper disks to push the upper slide downward; and two spring-biased upper displacement pieces mounted in the two upper disks;

the first one of the two upper disks of the upper joint has an interior provided with an upper slideway which has a wall provided with an upper opening which connects the upper slideway to an ambient environment;

a second one of the two upper disks of the upper joint has an interior provided with two upper locking grooves;

the upper slide of the upper joint is mounted in the upper slideway and has an end portion protruding outward from the upper opening;

the upper slide of the upper joint has a bottom provided with an upper locking portion inserted into one of the two upper locking grooves; and each of the two spring-biased upper displacement pieces of the upper joint is located beside and movable into one of the two upper locking grooves.

3. The rocking bed of claim 1, wherein: each of the lower joint of the pivot unit and the lower articulation of the connecting unit includes: two lower disks pivotally connected with each other; a lower slide mounted in a first one of the two lower disks; a lower elastic member biased between the lower slide and the first one of the two lower disks to push the lower slide downward; and two spring-biased lower displacement pieces mounted in the two lower disks; the first one of the two lower disks of the lower joint has an interior provided with a lower slideway which has a wall provided with a lower opening which connects the lower slideway to the ambient environment; a second one of the two lower disks of the lower joint has an interior provided with two lower locking grooves; the lower slide of the lower joint is mounted in the lower slideway and has an end portion protruding outward from the lower opening; the lower slide of the lower joint has a bottom provided with a lower locking portion inserted into one of the two lower locking grooves; and each of the two spring-biased lower displacement pieces of the lower joint is located beside and movable into one of the two lower locking grooves.

4. The rocking bed of claim 1, wherein:

the connecting unit further includes:

a retaining sleeve mounted on a top of the elbow pipe;

an extension bar having a lower end extending into the retaining sleeve and an upper end provided with a bent portion;

a push block mounted on the lower end of the extension bar and received in the retaining sleeve;

a fixed piece mounted in the retaining sleeve;

a spring biased between the fixed piece and the push block; and a mounting bracket pivotally connected with the bent portion of the extension bar;

the retaining sleeve has an interior provided with a plurality of slots;

the push block has a top provided with a plurality of inserts inserted into the slots of the retaining sleeve; and the mounting bracket has a periphery provided with a plurality of hanging holes for hanging dolls.

5. The rocking bed of claim 4, wherein the mounting bracket on the extension bar is used for hanging a mosquito curtain to cover the bed part supported by the top bars of the upper frame.

6. The rocking bed of claim 1, wherein the limit plate is provided with two dimples, and one of the two stands of the lower frame is provided with a spring-biased abutting block which has a protruding boss inserted into one of the two dimples of the limit plate.

7. The rocking bed of claim 1, wherein the first end of each of the bottom bars is secured to one of the two lower supports of the lower joint by a lower elastic plate, and each of the lower supports of the lower articulation is secured to the second end of one of the bottom bars by the lower elastic plate.

8. The rocking bed of claim 1, wherein the first end of each of the top bars is secured to one of the two upper supports of the upper joint by an upper elastic plate, and the second end of each of the top bars is secured to one of the two upper supports of the upper articulation by the upper elastic plate.

* * * * *